United States Patent [19]

Thomas, Jr. et al.

[11] Patent Number: 4,742,908

[45] **Date of Patent: * May 10, 1988**

[54] BAG WITH SOAKER PAD

[75] Inventors: John S. Thomas, Jr., Langhorne; John R. Carr, Phoenixville, both of Pa.

[73] Assignee: Paramount Packaging Corporation, Chalfont, Pa.

[ * ] Notice: The portion of the term of this patent subsequent to Oct. 28, 2003 has been disclaimed.

[21] Appl. No.: 867,354

[22] Filed: May 27, 1986

Related U.S. Application Data

[63] Continuation-in-part of Ser. No. 677,669, Dec. 3, 1984, Pat. No. 4,619,361, which is a continuation-in-part of Ser. No. 499,586, May 31, 1983.

[51] Int. Cl.[4] ..... B65D 81/26; B65D 81/22

[52] U.S. Cl. ..... 206/204; 206/205; 383/119; 426/124

[58] Field of Search ..... 206/554, 204, 205; 383/119, 120, 123; 426/124

[56] References Cited

U.S. PATENT DOCUMENTS

| | | | |
|---|---|---|---|
| 2,174,924 | 10/1939 | McCleary | 206/45.33 |
| 2,518,711 | 8/1950 | Mulford | 383/119 |
| 3,285,497 | 11/1966 | Stillman et al. | 383/9 |
| 3,372,857 | 3/1968 | Brayla | 206/554 |
| 3,804,322 | 4/1974 | Ericson | 206/554 |
| 4,124,116 | 11/1978 | McCabe, Jr. | 206/204 |
| 4,136,205 | 1/1979 | Quattlebaum | 383/119 |
| 4,321,997 | 3/1982 | Miller | 206/204 |
| 4,401,213 | 8/1983 | Lerner | 206/205 |
| 4,453,628 | 6/1984 | Walter | 229/2.5 R |
| 4,619,361 | 10/1986 | Thomas, Jr. | 206/204 |

*Primary Examiner*—Stephen Marcus

*Attorney, Agent, or Firm*—Seidel, Gonda, Goldhammer & Abbott

[57] ABSTRACT

A bag for packaging and displaying meat or poultry has a front and rear thermoplastic panel joined at a fold line at the bottom of the bag. An absorbent pad, having a non-stick layer, an absorbent layer and a securing device, is positioned at the bottom of the bag. The pad extends over both the front and rear panels and is secured to the panels. An opaque printing is provided on the panels and corresponds generally to the position of the pad.

14 Claims, 2 Drawing Sheets

14
20
26
24
12
26
22
2
54
2
10
56
28
50
48
48
16

20
54
10
14
12

18
58
38
28
32
50
46
34
42
36
52
40
44
16

32
36
38
28
34

4
38
40
28
4
50
44
42
52

BAG WITH SOAKER PAD

This is a continuation-in-part of co-pending application Ser. No. 677,669 filed on Dec. 3, 1984 now U.S. Pat. No. 4,619,361. This application is also a continuation-in-part of co-pending application Ser. No. 499,586 filed May 31, 1983.

BACKGROUND OF THE INVENTION

The invention is related to a bag for packaging and displaying the articles packaged therein. Particularly, the invention is related to a bag which will attractively display the contained articles, fresh meat and poultry, in a manner which is pleasing to a consumer.

Transparent plastic bags are often used in the packaging of fresh meats and poultry. This packaging technique is often used because meat preparation is done at a location away from the ultimate retail outlet. Thus, the bag performs at least two functions. First, the bag provides an impervious container which prevents contamination of the contained product. Second, the bag provides a transparent container which allows the consumer to inspect the contained product.

During the processing of the meat or poultry, it is impossible to remove all unwanted fluids such as blood from the prepared meat or poultry. The unwanted fluid seeps from the food product and is contained within the bag. The seepage occurs when the food product is placed in the bag, during transportation to the retailer and/or during display of the packaged food product by the retailer. The inclusion of the unwanted fluid within the package detracts from the appearance of the food product. The presence of the unwanted fluid within the package adversely affects the consumer.

In the past absorbent pads were hand loaded into the bags. The hand loading of the pads posed problems to packagers because of the time and expense associated with this hand loading operation. For example, 20 workers hand loading pads into bags and then filling the bags with food produced 96 bags per minute. The present invention permits bags to be machine loaded at the same rate of 96 bags per minute but with only 2 workers.

SUMMARY OF THE INVENTION

The present invention is a bag comprising a front and rear panel of a thermoplastic material. The panels are integral at a fold line to form a closed end of the bag. The bag is open at the other end to facilitate loading of the bag. Pad means are provided for absorbing fluids. The pad means includes a non-stick pervious layer, an absorbent layer and a securing means. The absorbent layer is between the non-stick layer and the securing means. The components of the pad means are joined together. The absorbent layer is exposed along an edge of the pad means. The pad means has a fold line juxtaposed to the first mentioned fold line, so that a first portion of the pad means overlays a portion of the front panel and a second portion of the pad means overlays a portion of the rear panel. The pad means is secured adjacent an end thereof to the front panel. The second portion of the pad means is secured adjacent an end thereof to the rear panel.

The pervious layer of the pad is of a color different than the absorbent inner layer. The color is to assist in the concealment of the collected fluids. The opaque printing at the bottom of the front and rear panels of the bag also aids in the obscuring of the unwanted fluids.

Furthermore, the pervious layer will not adhere to the inserted material. The non-stick ability of the absorbent pad prevents the unintentional removal of the pad when the meat is removed by the consumer.

An object of this invention is to provide a bag which will obscure the presence of unsightly fluids which have seeped from the contained meat product.

A further object is to provide an attractive package which will have greater consumer appeal.

Another object of this invention is to provide a package that is easier for the packager to use. This bag eliminates the operation of hand loading a pad into the bag.

A still further object of the invention is to provide a package that can be loaded on a fully automated packing line.

DESCRIPTION OF DRAWINGS

For the purpose of illustrating the invention, there is shown in the drawings a form which is presently preferred; it being understood, however, that this invention is not limited to the precise arrangements and instrumentalities shown.

DETAILED DESCRIPTION OF THE INVENTION

Figure 1:
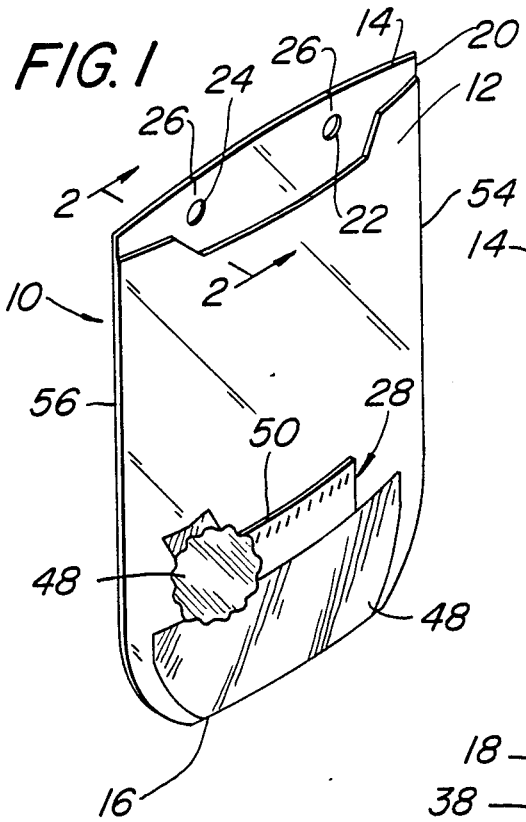
FIG. 1 is a perspective view showing a bag in accordance with the present invention.

Referring to the drawings, wherein like numerals indicate like elements, there is shown in FIG. 1 a bag 10. The bag 10 has a front panel 12 and a rear panel 14 made of a single sheet of thermoplastic material. The sheet is folded back upon itself at a fold line 16. The front panel 12 and rear panel 14 are preferably thermally welded along side seam lines 54 and 56. The bag 10 is generally rectangular in shape but preferably has rounded corners at the closed end of the bag as shown in FIG. 1. The front panel 12 overlays the back panel 14, and a lip 20 of the back panel 14 extends beyond the front panel 12. The back panel 14 may have a pair of holes 22 and 24 located in the lip 20 which is at the end away from the fold line 16. Tear lines 26 are positioned above the holes 22 and 24 which cut through the back panel 14. The pair of holes 22 and 24 and tear lines 26 facilitate the machine loading of the bag 10.

An absorbent pad 28 is shown at the bottom of the bag defined by fold line 16. On the front panel 12 and rear panel 14, at the bottom of the bag 10 towards fold line 16 is shown an opaque printing 48. The printing 48, shown in FIG. 1, extends along a portion of the width of the front and rear panels 12 and 14, but may extend along the entire width of the panels 12 and 14. The printing 48 is optional but preferred.

The color of the opaque printing 48 may be related to the trade dress colors of the meat or poultry preparer, or may be of a color which corresponds to the material inserted into the bag, or may be of a color which will obscure the unwanted fluid. Printing 48 is preferably located so as to conceal at least a portion of pad 28.

An open end of the bag 10 is provided opposite the fold line 16, so to facilitate the insertion of the meat or poultry by hand or machine. See FIG. 2. After the inserted material 58 is placed within the bag 10, the open end may be thermally welded closed. Any trim left over is discarded.

Figure 2:
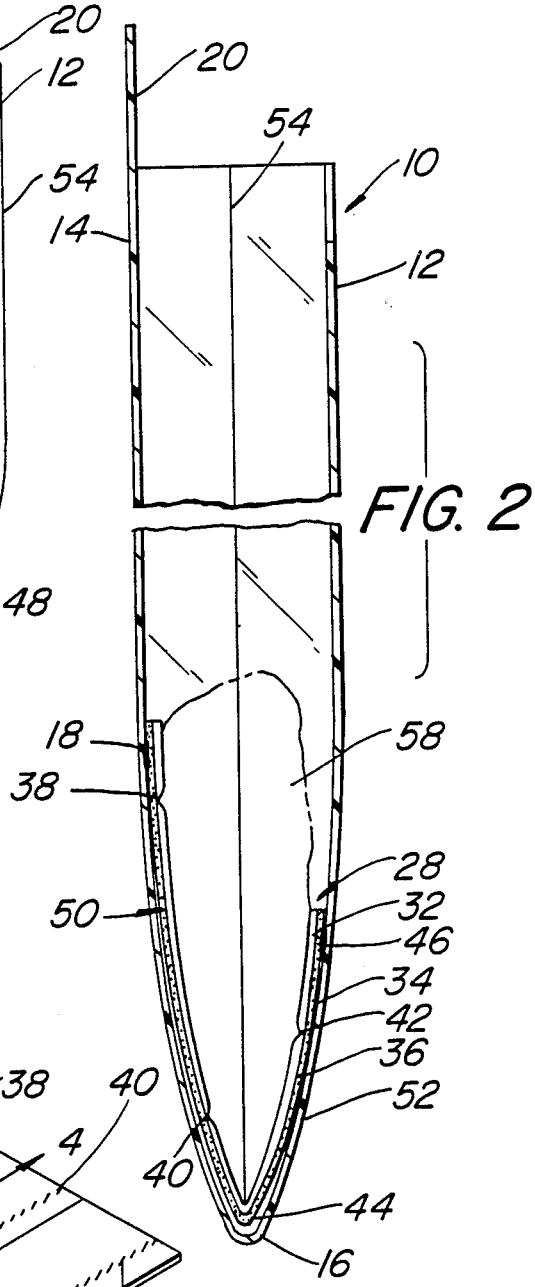
FIG. 2 is a cross-sectional view of the bag of FIG. 1 taken along lines 2—2 of FIG. 1.

In FIG. 2, the pad 28 is shown disposed in the bottom portion of the bag 10 with a fold line 44 parallel to the fold line 16. A pad portion 50 is in face contact with the rear panel 14. A second pad portion 52 is in face contact with the front panel 12. The pad portion 50 is generally longer than the pad portion 52. Preferably, a plurality of perforated lines 38, 40 and 42 are located on the pad 28. These perforated lines 38, 40 and 42 run the width of pad 28 and are parallel to the fold line 44 of the pad 28. The perforated lines 38, 40 and 42 provide portals through which fluid may be absorbed by an absorbent layer 36 of the pad 28.

Figure 7:
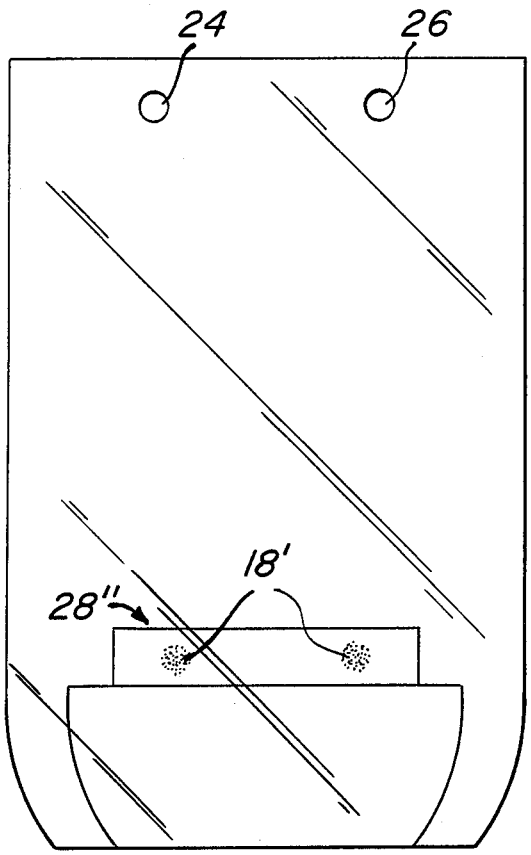
FIG. 7 is a rear view of an alternative embodiment of the present invention.

The pad 28 is preferably thermally welded to the front panel 12 at thermal weld line 46. The back pad portion 50 is preferably thermally welded to the rear panel 14 along weld line 18. Alternatively, the pad can be secured to the bag by glue or other adhesives 18'. See FIG. 7. Such glues or adhesives are well-known to those skilled in the art.

When the pad 28 is thermally welded, preferably it will have a back coat of a thermoplastic material to bond with the thermoplastic material of the front and rear panels of the bag. The back coat can be any free film 34 of thermally weldable material or a film 34' of extruded thermally weldable material. The film 34' of extruded material is applied directly to the absorbent material.

The pad 28 is thermally welded to the front panel 12 and rear panel 14 by a machine, thus eliminating the need to hand load the pad 28 into the bag 10. Placement of the pad 28 on the front panel 12 and rear panel 14 may be performed before the bag 10 is folded back upon itself.

Weld line 18 is preferably positioned above the perforated line 38 and toward the uppermost end of pad portion 50. The weld line 18 is positioned above the perforated line 38 so to prevent the pad from folding over upon itself and obstructing the perforated line 38. The weld line 46 between the front panel 12 and pad portion 52 is similarly positioned at the uppermost end of the pad portion 52 and above the perforated line 42 so to prevent the pad portion 52 from folding over the perforated line 42 and obstructing the line 42. Likewise, the glue 18' or adhesive can be placed above the perforated line.

Figure 3:
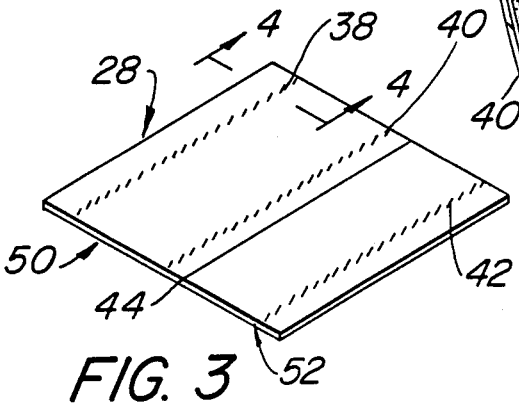
FIG. 3 is a plane view of the absorbent insert.

FIG. 3 is a plan view of a preferred embodiment of the pad 28. The pad 28 includes impervious layers 32 and 34 sandwiching non-woven absorbent layer 36. See FIG. 4. The pad 28 is generally square having a number of perforated lines 38, 40 and 42 spaced apart on the impervious layers 32 and 34. The perforated lines 38, 40 and 42 perform a dual function. The first function provides a means through which unwanted fluid may pass into the absorbent layer 36. See FIG. 4. The second function is to provide a means to bind together the layers 32, 36 and 34. The second function is attained by using a heated tool to make the perforations.

Alternatively, the pad 28' and 28'' comprise a non-stick pervious material and an absorbent layer. The nonstick pervious material and the absorbent layer are known as "COFORM" which is commercially available from Kim Fibers, a Division of Kimberly-Clark Inc. of Neenah, Wisconsin. The non-stick pervious layer 32' is made of a spun bound material. A spun bound material is a non-woven fabric made from continuous filament fibers which are bound at crossover points immediately after the fibers have been extruded from a spinneret. The absorbent layer 36 need not be limited to only non-woven material, but any absorbent material which can be used with foods. The pad 28'' with no back coat is preferably glued to the bag. See FIGS. 6 and 7.

Figure 4:
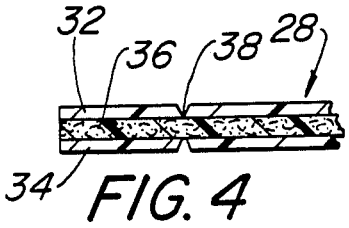
FIG. 4 is a cross-sectional view of the absorbent pad of FIG. 3 taken along lines 4—4 of FIG. 3.
Figure 5:
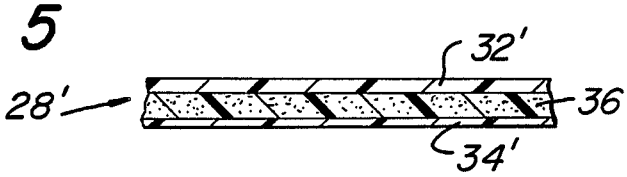
FIG. 5 is a cross-sectional view of an alternative embodiment of the absorbent pad.
Figure 6:
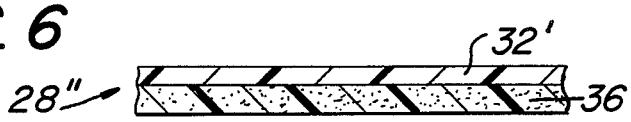
FIG. 6 is a cross-sectional view of an alternative embodiment of the absorbent pad.

As shown in FIGS. 3 and 4, the edges of the pad 28 are open such that the absorbent layer 36 is exposed along each edge of the pad 28. The pads 28' and 28'' shown in FIGS. 5 and 6 are preferably exposed along the edges. This additional exposure of the pad 36 further facilitates the absorption of unwanted fluids. The impervious layers 32 and 34 shown in FIG. 4 are of a color which is different from the absorbent layer 36, which is generally white. The color of the layers 32 and 34 may correspond to the trade dress colors of the meat preparer or to the color of the inserted article 58, or to the color of the unwanted fluid. The color of the layers 32 and 34 should be opaque so to obscure the absorbed unwanted fluid absorbed by the layer 36.

It is understood that the bag 10 of the present invention provides an improved package for articles, such as poultry and meat. When bag 10 is filled with poultry such as a chicken, the rounded corners enable the bag 10 to conform to the shape of the chicken. The use of opaque printing 48 and opaque impervious layers 32 and 34 on the absorbent pad 28 obstructs the view of unwanted fluids which collect at the bottom of the bag 10. This opaqueness in turn, enhances the appearance of the package and improves the consumer appeal of the material enclosed.

The present invention may be embodied in other specific forms without departing from the spirit or essential attributes thereof and, accordingly, reference should be made to the appended claims, rather than to the foregoing specification, as indicating the scope of the invention.

We claim:

1. A bag for goods comprising a front and rear panel of a thermoplastic material, said panels being integral at a fold line to form a closed end of the bag, the bag being open at the other end to facilitate loading of the bag, pad means for absorbing fluids, said pad means including a non-stick pervious layer, an absorbent layer and a securing means, said absorbent layer being between said non-stick layer and said securing means, said pad means being joined together, said absorbent layer being exposed along an edge of the said pad means, said pad means having a fold line juxtaposed to said first mentioned fold line, so that a first portion of the pad means overlays a portion of the front panel and a second portion of the pad means overlays a portion of the rear panel, said pad means being secured adjacent an end thereof to said front panel, and said second portion of the pad means being secured adjacent an end thereof to said rear panel.

2. The bag according to claim 1 further comprising said bag having printing thereon and correlated with the location of said pad means.

3. The bag according to claim 1 wherein said securing means comprises an adhesive which joins the absorbent layer to the panels.

4. The bag according to claim 1 further comprising said pad means being joined together by a plurality of perforations.

5. The bag according to claim 1 further comprising said bag having printing thereon and correlated with the location of said pad means.

6. The bag according to claim 5 wherein the printing is opaque and extends along a portion of the width of the front and rear panels.

7. The bag according to claim 3 wherein the printing is opaque and extends to a height on the front and rear portions of the bag which is no greater than the back portion of the pad means.

8. A bag for goods comprising a front and rear panel of a thermoplastic material, said panels being integral at a fold line to form a closed end of the bag, the bag being open at the other end to facilitate loading of the bag, pad means for absorbing fluids from goods in the bag, said pad means including a non-stick layer, an absorbent layer and a securing means, said absorbent layer being between said non-stick layer and said securing means, said pad means being joined together by a plurality of perforations, said absorbent layer being exposed along an edge of said pad means, said pad means having a fold line juxtaposed to said first-mentioned fold line, so that a first portion of the pad means overlays a portion of the front panel and a second portion of the pad means overlays a portion of the rear panel, said first portion of the pad means being secured adjacent a free end thereof to said front panel, and said second portion of the pad means being secured adjacent a free end thereof to said rear panel.

9. A bag for goods comprising a front and rear panel of a thermoplastic material, said panels being integral at a fold line to form a closed end of the bag, the bag being open at the other end to facilitate loading of the bag, pad means for absorbing fluids from goods in the bag, said pad means including an absorbent layer, a nonstick layer and a securing means, said absorbing layer being between said non-stick layer and said securing layer, said pad means joined together by a plurality of perforations, said absorbent layer being exposed along an edge of said pad means, said pad means having a fold line juxtaposed to said first mentioned fold line, so that a first portion of the pad means overlays a portion of the front panel and a second portion of the pad means overlays a portion of the rear panel, said first portion of the pad means being secured adjacent a free end thereof to said front panel, said second portion of the pad means being secured adjacent a free end thereof to said rear panel and said rear panel having a flap having at least two holes therein, said flap being located adjacent the open end.

10. The bag according to claim 9 wherein said securing means comprises a thermoplastic layer joined to the absorbent layer and a thermal weld securing the pad means to said panels.

11. The bag according to claim 9 wherein said securing means comprises an adhesive which joins the absorbent layer to the panels.

12. The bag according to claim 9 wherein the second portion of the pad means is longer than the first portion of the pad means.

13. The bag according to claim 9 further comprising an opaque printing disposed on the front panel concealing the first portion of the pad means.

14. The bag according to claim 9 wherein the front and rear panels have rounded corners adjacent the closed end of the bag.

* * * * *